US008723420B2

(12) United States Patent
Ishii et al.

(10) Patent No.: US 8,723,420 B2
(45) Date of Patent: May 13, 2014

(54) MAGNETRON AND MICROWAVE-USING EQUIPMENT

(75) Inventors: Takeshi Ishii, Shiga (JP); Nagisa Kuwahara, Shiga (JP); Etsuo Saitou, Shiga (JP)

(73) Assignee: Panasonic Corporation, Osaka (JP)

( * ) Notice: Subject to any disclaimer, the term of this patent is extended or adjusted under 35 U.S.C. 154(b) by 143 days.

(21) Appl. No.: 13/141,270

(22) PCT Filed: Dec. 17, 2009

(86) PCT No.: PCT/JP2009/006994

§ 371 (c)(1),
(2), (4) Date: Jun. 21, 2011

(87) PCT Pub. No.: WO2010/073564

PCT Pub. Date: Jul. 1, 2010

(65) Prior Publication Data

US 2011/0254442 A1 Oct. 20, 2011

(30) Foreign Application Priority Data

Dec. 25, 2008 (JP) ..... 2008-329943

(51) Int. Cl.
*H01J 25/50* (2006.01)

(52) U.S. Cl.
USPC ..... 315/39.51

(58) Field of Classification Search
USPC ..... 315/39.51
See application file for complete search history.

(56) References Cited

U.S. PATENT DOCUMENTS

| | | | | |
|---|---|---|---|---|
| 6,717,365 | B2 * | 4/2004 | Lee et al. | 315/39.51 |
| 6,756,735 | B2 * | 6/2004 | Lee et al. | 315/39.51 |
| 7,023,137 | B2 * | 4/2006 | Ishii et al. | 315/39.51 |
| 2003/0070922 | A1 | 4/2003 | Ishii et al. | |

FOREIGN PATENT DOCUMENTS

| | | | |
|---|---|---|---|
| EP | 1 286 379 | A2 | 2/2003 |
| JP | 63-193439 | A | 8/1988 |
| JP | 02-050943 | U | 4/1990 |
| JP | 02-112132 | A | 4/1990 |
| JP | 05-082029 | A | 4/1993 |
| JP | 05-299023 | A | 11/1993 |

OTHER PUBLICATIONS

Ryoichi, Magnetron Device, JP 63-193439 A, (Matsushita Electronics Corp.), Aug. 10, 1988, pp. 173-176.*
International Search Report for International Application No. PCT/JP2009/006994, dated Jan. 26, 2010, 2 pages.
Extended European Search Report in corresponding European Application No. 09 83 4376.7, dated Jan. 8, 2014, 5 pages.

* cited by examiner

*Primary Examiner* — Alexander H Taningco
*Assistant Examiner* — David Lotter
(74) *Attorney, Agent, or Firm* — Brinks Gilson & Lione

(57) ABSTRACT

A magnetron includes an anode cylinder; a cathode side tube hermetically coupled to a lower portion of the anode cylinder; and a shield cylinder. The shield cylinder includes a cylindrical part extending in substantially a vertical direction, a flange part which is connected to the cylindrical part and extends in substantially a horizontal direction over the entire periphery of the cylindrical part, and a folded part in which a portion of the flange part is folded toward the cathode side tube. The shield cylinder is electrically coupled to the cathode side tube at a lower end of the anode cylinder.

5 Claims, 3 Drawing Sheets

MAGNETRON AND MICROWAVE-USING EQUIPMENT

This application is a 371 application of PCT/JP2009/006994 having an international filing date of Dec. 17, 2009, which claims priority to JP2008-329943 filed on Dec. 25, 2008, the entire contents of which are incorporated herein by reference.

TECHNICAL FIELD

The present invention relates to a magnetron and a microwave-using equipment, and particularly to the magnetron used in the microwave-using equipment such as a microwave oven.

BACKGROUND ART

In a magnetron described in Patent Document 1, in order to interpose a circularly annular yoke plate in which small projections for small air gap formation are scattered, folding processing is applied so as to form an air gap between a magnetic pole piece (hereinafter called a pole piece) and the sintered magnet (hereinafter called an annular magnet). Patent Document 1 discloses a technique for interposing the circularly annular yoke plate in the air gap between the pole piece and the annular magnet in order to prevent electromagnetic waves generated at the time of operating the magnetron from leaking to the outside of an apparatus.

RELATED ART DOCUMENTS

Patent Documents

Patent Document 1: JP-A-5-82029

SUMMARY OF THE INVENTION

Problem to be Solved by the Invention

Conventionally, in a core tube of the magnetron, coaxial adjustment is made by deforming a cathode side tube, so that depending on a method of construction between the pole piece and the annular magnet, the adjusted coaxiality may return to a state before the adjustment because of contact between a shield cylinder and the cathode side tube when an exterior of the magnetron is assembled.

An object of the invention is to provide a magnetron capable of performing exterior assembly work of the magnetron in a state of holding deformation of a cathode side tube for coaxial adjustment of a cathode filament.

Means for Solving the Problem

The invention provides a magnetron including: an anode cylinder; a cathode side tube hermetically coupled to a lower portion of the anode cylinder; and a shield cylinder including a cylindrical part extending in a substantially vertical direction, a flange part connected to the cylindrical part and extending in a substantially horizontal direction over an entire periphery of the cylindrical part, and a folded part in which a portion of the flange part is folded toward the cathode side tube, the shield cylinder being electrically coupled to the cathode side tube at a lower end of the anode cylinder.

In the magnetron, the folded part is formed by folding a free end of the flange part, which is the portion of the flange part, toward the cathode side tube.

In the magnetron, the folded part is formed by cutting the portion of the flange part in substantially a U shape and folding a cut portion of the flange part toward the cathode side tube.

A microwave-using equipment of the invention includes the magnetron mounted therein.

Advantages of the Invention

According to the magnetron according to the invention, exterior of the magnetron can be assembled in a state of holding deformation of the cathode side tube for coaxial adjustment of a cathode filament.

MODE FOR CARRYING OUT THE INVENTION

An embodiment of the invention will hereinafter be described with reference to the drawings.

Figure 1:
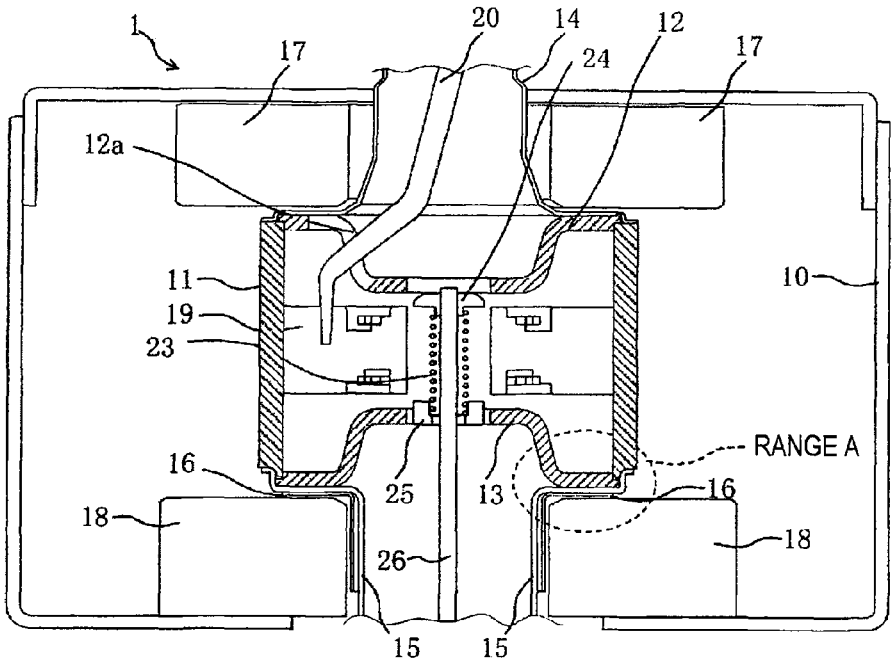
FIG. 1 is a diagram showing the whole configuration of a magnetron 1 of the present embodiment.

FIG. 1 is a diagram showing the whole configuration of a magnetron 1 of the present embodiment.

In FIG. 1, the magnetron 1 of the first embodiment has a magnetic yoke 10, an anode cylinder 11, an output side pole piece 12 coupled to an upper end opening of the anode cylinder 11, an input side pole piece 13 coupled to a lower end opening of the anode cylinder 11, an anode side tube 14 hermetically coupled to the upper end opening of the anode cylinder 11, the anode side tube 14 with which the output side pole piece 12 is covered, a cathode side tube 15 hermetically coupled to the lower end opening of the anode cylinder 11, the cathode side tube 15 with which the input side pole piece 13 is covered, an annular magnet 17 placed inside the magnetic yoke 10 so as to be inserted into the anode side tube 14 just over the anode cylinder 11, and an annular magnet 18 placed inside the magnetic yoke 10 so as to be inserted into the cathode side tube 15 just under the anode cylinder 11.

Also, a shield cylinder 16 which is one feature of the invention is interposed between the cathode side tube 15 hermetically coupled to the lower end opening of the anode cylinder 11 and the annular magnet 18 placed inside the magnetic yoke 10 just under the anode cylinder 11. The shield cylinder 16 can prevent electromagnetic waves generated inside the magnetron 1 from leaking to the outside of an apparatus by being interposed between the cathode side tube 15 and the annular magnet 18 as shown in FIG. 1. Also, the shield cylinder 16 has functions of preventing high-temperature demagnetization or damage from a rise in temperature of the annular magnet 18.

The inside of the anode cylinder 11 is provided with a spiral cathode filament 23, a center lead 26 for supporting the cathode filament 23, plural anode vanes 19, and an output antenna 20 upward extending along the central axis of the anode cylinder 11 from the one anode vane 19. The plural anode vanes 19 are placed at a predetermined distance along an inner peripheral surface of the anode cylinder 11. The output antenna 20 extends from the one anode vane 19 toward the output side pole piece 12 coupled to the upper end opening of the anode cylinder 11 and further upward extends along the central axis of the anode cylinder 11 through a hole 12*a* formed in a portion of the inclined wall of the output side pole piece 12. The spiral cathode filament 23 extends from an upper end shield 24 to a lower end shield 25 along the central axis of the anode cylinder 11. One end of the cathode filament 23 is fastened to the upper end shield 24 and the other end of the cathode filament 23 is fastened to the lower end shield 25.

The center lead 26 extends from the upper end shield 24 to a stem (not shown) inside the cathode filament 23. The center lead 26 is fastened to the upper end shield and supports the cathode filament 23.

Figure 2A:
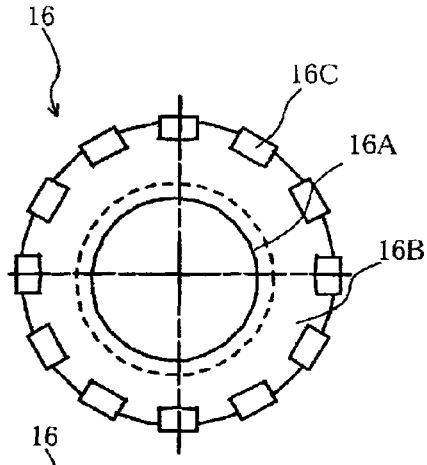
FIG. 2(*a*) is a plan view in the case of viewing a shield cylinder 16 from above and FIG. 2(*b*) is a sectional view of the shield cylinder 16.
Figure 2B:
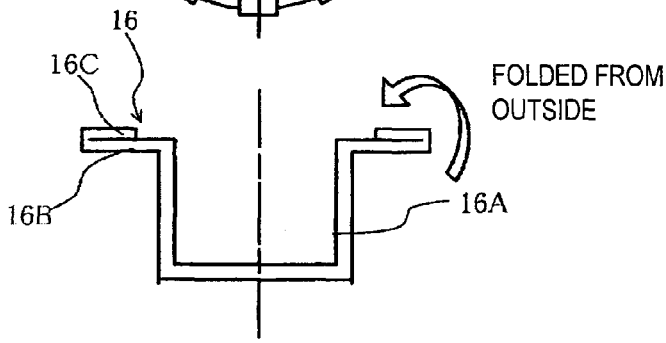

Next, the whole configuration of the shield cylinder 16 which is one feature of the invention will be described with reference to FIGS. 2(*a*) and 2(*b*). FIG. 2(*a*) is a plan view in the case of viewing the shield cylinder 16 from above, and FIG. 2(*b*) shows a sectional view of the shield cylinder 16.

As shown in FIGS. 2(*a*) and 2(*b*), the shield cylinder 16 includes a cylindrical part 16A extending in substantially a vertical direction and a flange part 16B extending in substantially a horizontal direction over the entire periphery of the cylindrical part 16A from one end of the cylindrical part 16A, and is constructed as an eyelet-shaped cylinder as a whole. Also, as shown in FIG. 2(*a*), folded parts 16C formed in the end of the flange part 16B are placed at a predetermined distance over the entire periphery of the flange part 16B. Also, as shown by an arrow in FIG. 2(*b*), the folded part 16C is formed by folding a free end of the flange part 16B from the outside of the cylindrical part 16A of the shield cylinder 16 toward the inside.

Figure 3A:
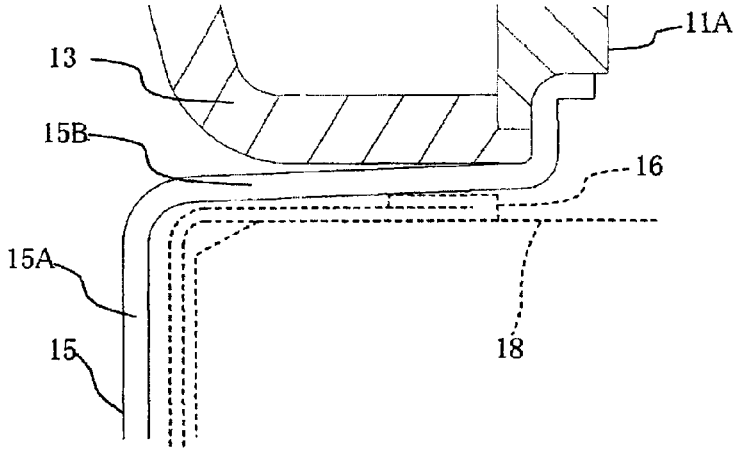
FIG. 3(*a*) is an enlarged sectional view of a range A enclosed by a dotted line of FIG. 1 before the shield cylinder 16 and an annular magnet 18 are incorporated into the magnetron 1, FIG. 3(*b*) is an enlarged sectional view of the range A after the shield cylinder 16 and the annular magnet 18 are incorporated into the magnetron 1 and FIG. 3(*c*) is an enlarged sectional view of the range A after a conventional shield cylinder 96 and the annular magnet 18 are incorporated into the magnetron 1.
Figure 3B:
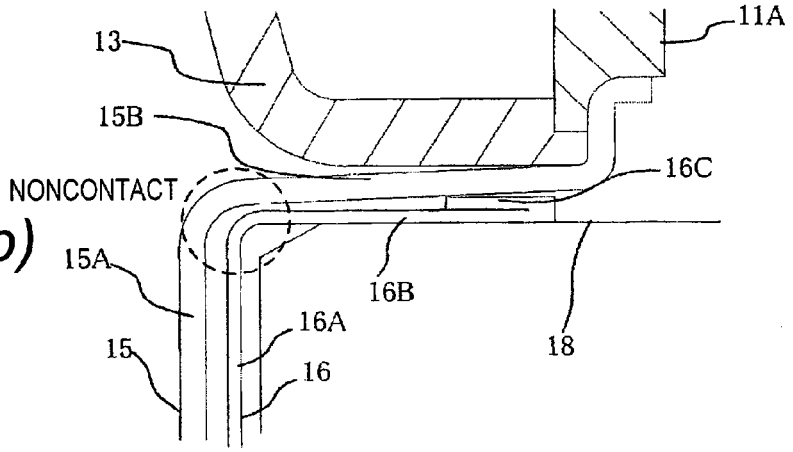
Figure 3C:
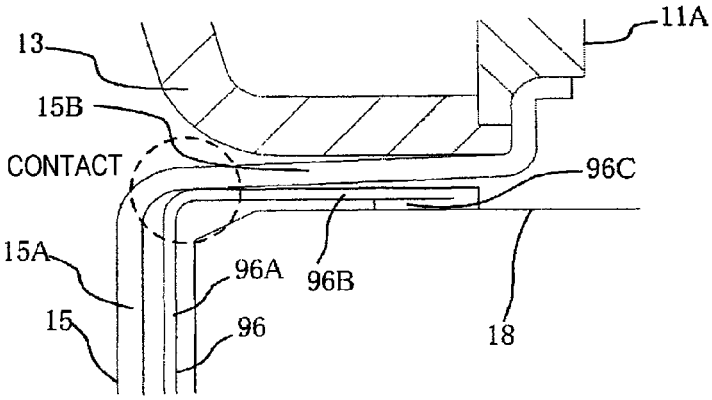

Next, in work of incorporating the shield cylinder 16 and the annular magnet 18 into the magnetron 1, the embodiment is compared with a conventional example with reference to FIGS. 3(*a*) to 3(*c*).

FIG. 3(*a*) is an enlarged sectional view of a range A enclosed by a dotted line of FIG. 1 before the shield cylinder 16 and the annular magnet 18 are incorporated into the magnetron 1, and FIG. 3(*b*) is an enlarged sectional view of the range A after the shield cylinder 16 and the annular magnet 18 are incorporated into the magnetron 1. Also, FIG. 3(*c*) is an enlarged sectional view of the range A after a conventional shield cylinder 96 and the annular magnet 18 are incorporated into the magnetron 1.

As shown in FIG. 3(*a*), a flange part 15B of the cathode side tube 15 hermetically coupled to the lower end opening 11A of the anode cylinder 11 is downward inclined from a free end of the flange part 15B toward a cylindrical part 15A. As a result, a height from the magnetic yoke 10 to the flange part 15B becomes lower from the free end of the flange part 15B toward the cylindrical part 15A. Therefore, space for incorporating the shield cylinder 16 and the annular magnet 18 becomes slightly narrower from the lower end opening 11A of the anode cylinder 11 toward the central axis of the anode cylinder 11. The reason why the flange part 15B of the cathode side tube 15 is inclined from the free end of the flange part 15B toward the cylindrical part 15A thus is because coaxial adjustment is made by deforming the cathode side tube 15 before the shield cylinder 16 and the annular magnet 18 are incorporated into the magnetron 1 in order to align the axis of the cathode filament 23 of the inside of the anode cylinder 11 with the axis of the anode cylinder 11.

Because of that, it is necessary to prevent the cathode side tube 15 from being deformed from a state of making the coaxial adjustment.

However, in the shield cylinder 96 of the conventional example, a folded part 96C formed in the end of a flange part 96B is folded toward the annular magnet 18 rather than toward the cathode side tube 15 as shown in FIG. 3(*c*). As a result, a boundary between a cylindrical part 96A and the flange part 96B makes contact with a boundary between the cylindrical part 15A and the flange part 15B of the cathode side tube 15, and the cathode side tube 15 is deformed from the state of making the coaxial adjustment, and the axis of the cathode filament 23 of the inside of the anode cylinder 11 is not aligned with the axis of the anode cylinder 11.

Hence, in the embodiment, the folded part 16C formed in the free end of the flange part 16B is folded toward the cathode side tube 15 at the time of incorporating the shield cylinder 16 into the magnetron 1 as shown in FIG. 3(*b*). In other words, the folded part 16C projects toward the cathode side tube 15 rather than toward the annular magnet 18 with respect to the flange part 16B. As a result, a boundary between the cylindrical part 16A and the flange part 16B of the shield cylinder 16 does not make contact with the boundary between the cylindrical part 15A and the flange part 15B, and the cathode side tube 15 is not deformed from the state of making the coaxial adjustment.

Therefore, the magnetron 1 of the embodiment can hold deformation of the cathode side tube 15 performed in order to align the axis of the cathode filament 23 of the inside of the anode cylinder 11 with the axis of the anode cylinder 11. Also, this deformation of the cathode side tube 15 can be held, so that the need for another coaxial adjustment is eliminated and exterior assembly work of the magnetron 1 is facilitated.

Figure 4A:
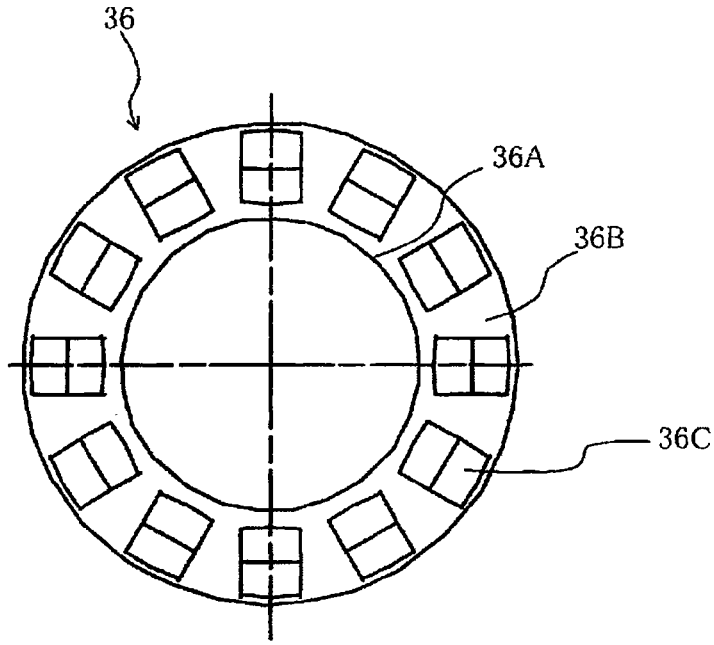
FIG. 4(*a*) is a plan view in the case of viewing a shield cylinder 36 which is another embodiment of the shield cylinder in the embodiment from above and FIG. 4(*b*) is a sectional view of the shield cylinder 36.
Figure 4B:
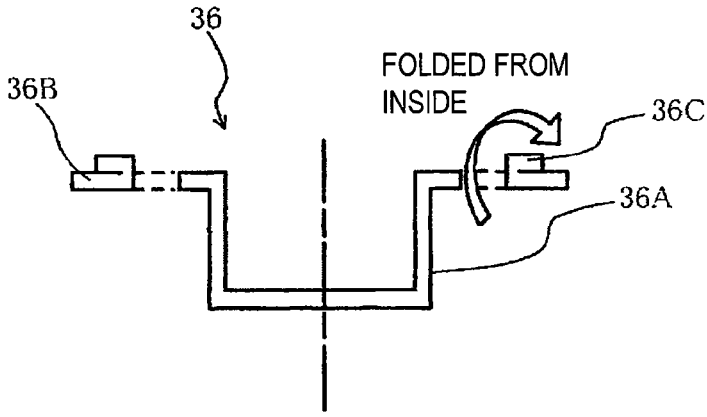

As shown in FIGS. 4(*a*) and 4(*b*), another embodiment of the shield cylinder in the present embodiment is shown. FIG. 4(*a*) is a plan view in the case of viewing a shield cylinder 36 which is another embodiment of the shield cylinder in the embodiment from above, and FIG. 4(*b*) shows a sectional view of the shield cylinder 36.

As shown in FIGS. 4(*a*) and 4(*b*), the shield cylinder 36 includes a cylindrical part 36A extending in substantially a vertical direction and a flange part 36B extending in substantially a horizontal direction over the entire periphery of the cylindrical part 36A from one end of the cylindrical part 36A, and is constructed as an eyelet-shaped cylinder as a whole. Also, as shown in FIG. 4(*a*), folded parts 36C formed in the flange part 16B are placed at a predetermined distance over the entire periphery of the flange part 36B. Also, as shown by an arrow in FIG. 4(*b*), the folded part 36C is formed by cutting a portion of the flange part 36B in substantially a U shape and folding a cut portion of the flange part 36B toward a cathode side tube 15.

Here, when the shield cylinder 36 is incorporated into a magnetron 1, the folded part 36C projects toward the cathode side tube 15 at the time of incorporating the shield cylinder 36 into the magnetron 1 like the shield cylinder 16 in the embodiment. As a result, a boundary between the cylindrical part 36A and the flange part 36B of the shield cylinder 36 does not make contact with a boundary between a cylindrical part 15A and a flange part 15B of the cathode side tube 15, and the cathode side tube 15 is not deformed from a state of making coaxial adjustment.

Therefore, even when the shield cylinder 36 which is another embodiment is used instead of the shield cylinder 16 in the embodiment, the magnetron 1 of the embodiment can hold deformation of the cathode side tube 15 performed in order to align the axis of a cathode filament 23 of the inside of an anode cylinder 11 with the axis of the anode cylinder 11. Also, this deformation of the cathode side tube 15 can be held, so that the need for another alignment is eliminated and exterior assembly work of the magnetron 1 is facilitated.

The various embodiments of the invention have been described above, but the invention is not limited to the items shown in the embodiment described above, and the invention intends to make change and application by persons skilled in the art based on well-known techniques and the mention of the description, and the change and application are included in the scope of protection.

The present application is based on Japanese patent application (patent application No. 2008-329943) filed on Dec. 25, 2008, and the contents of the patent application are hereby incorporated by reference.

Industrial Applicability

A magnetron according to the invention has an effect of holding deformation of a cathode side tube for alignment of a cathode filament and eliminating the need for alignment at the time of exterior assembly work of the magnetron, and is useful as a microwave-using equipment such as a microwave oven. Also, the microwave-using equipment according to the invention can obtain stable characteristics.

The invention claimed is:

1. A magnetron comprising:

an anode cylinder;

a cathode side tube hermetically coupled to a lower portion of the anode cylinder, the cathode side tube comprising a cylindrical part extending in a substantially vertical direction and a flange part connected to the cylindrical part and extending in a substantially horizontal direction over a periphery of the cylindrical part; and a shield cylinder comprising:

a cylindrical part extending in the substantially vertical direction;

a flange part connected to the cylindrical part of the shield cylinder and extending in the substantially horizontal direction over an entire periphery of the cylindrical part of the shield cylinder, wherein an upper surface of the flange part of the shield cylinder faces a lower surface of the flange part of the cathode side tube; and a folded part in which a portion of the flange part of the shield cylinder is folded toward the flange part of the cathode side tube, wherein the folded part is in contact with a portion of the lower surface of the flange part of the cathode side tube, the shield cylinder being electrically coupled to the cathode side tube at a lower end of the anode cylinder.

2. The magnetron according to claim 1, wherein the folded part is formed by folding a free end of the flange part of the shield cylinder, which is the portion of the flange part of the shield cylinder, toward the flange part of the cathode side tube.

3. The magnetron according to claim 1, wherein the folded part is formed by cutting the portion of the flange part of the shield cylinder in substantially a U shape and folding a cut portion of the flange part of the shield cylinder toward the flange part of the cathode side tube.

4. The magnetron according to claim 1, wherein an unfolded part of the flange part of the shield cylinder is separated from the flange part of the cathode side tube by the folded part.

5. The magnetron according to claim 1, further comprising a gap defined between a portion of the shield cylinder where the flange part and cylinder part connect and a portion of the cathode side tube where the flange part and the cylinder part connect.

* * * * *